US006962036B2

(12) United States Patent
Salva Transfiguracion et al.

(10) Patent No.: US 6,962,036 B2
(45) Date of Patent: Nov. 8, 2005

(54) PROCEDURE FOR FILLING FLEXIBLE RECIPIENTS NORMALLY SET ON CRATE-TYPE RIGID OR SEMI-RIGID PALLETIZED RECEPTACLES AND THE SET OF DEVICES REQUIRED FOR PERFORMING SAID FILLING OPERATION

(76) Inventors: Vicente Salva Transfiguracion, Fola, 9-1-B, Castellon (ES) E-12002; Felipe Puig Aguilella, Mayor San Jaime, 38-6, Vila-Real (ES) E-12540

( * ) Notice: Subject to any disclaimer, the term of this patent is extended or adjusted under 35 U.S.C. 154(b) by 160 days.

(21) Appl. No.: 10/718,121

(22) Filed: Nov. 20, 2003

(65) Prior Publication Data

US 2004/0112012 A1 Jun. 17, 2004

(30) Foreign Application Priority Data

Nov. 22, 2002 (ES) ..... 200202687

(51) Int. Cl.[7] ..... B65B 3/00; B65D 25/14

(52) U.S. Cl. ..... 53/170; 141/114; 220/9.4; 220/495.05

(58) Field of Search ..... 53/170, 175, 390, 53/449, 469; 141/10, 114, 313; 220/9.4, 220/495.04, 495.05

(56) References Cited

U.S. PATENT DOCUMENTS

| | | | | |
|---|---|---|---|---|
| 3,377,766 A * | 4/1968 | Nelson | 53/449 |
| 3,687,061 A * | 8/1972 | Eggenmuller et al. | 141/114 |
| 5,897,012 A * | 4/1999 | Sortwell | 220/9.4 |
| 5,979,685 A * | 11/1999 | tz | 220/9.4 |
| 6,019,147 A * | 2/2000 | Prescott et al. | 141/114 |
| 6,454,113 B1 * | 9/2002 | Schutz | 200/9.4 |
| 6,516,965 B1 * | 2/2003 | Perkins | 220/9.4 |

FOREIGN PATENT DOCUMENTS

| | | |
|---|---|---|
| DE | 29 00 998 | 7/1980 |
| EP | 0 362 730 | 4/1990 |
| EP | 0 642 453 | 1/1996 |
| FR | 2 395 913 | 1/1979 |
| FR | 2 525 568 | 10/1983 |
| GB | 1051516 | 12/1966 |
| GB | 2 194 512 | 3/1988 |
| GB | 2 246 336 | 1/1992 |
| WO | WO 95/18754 | 7/1995 |

* cited by examiner

*Primary Examiner*—John Sipos
(74) *Attorney, Agent, or Firm*—Richard M. Goldberg

(57) ABSTRACT

A device and process for filling flexible receptacles set on rigid or semi-rigid outer receptacles, includes, prior to usage, rolling up a flexible receptacle having upper loading and lower unloading mouths, and fitting a wrapping around the rolled-up receptacle; and during usage, fitting the flexible receptacle in a rigid or semi-rigid outer receptacle such that the lower unloading mouth of the flexible receptacle is positioned in a lower recess of the rigid or semi-rigid receptacle, fitting an upper bridge having a slot on the outer receptacle to control unfolding of the flexible receptacle during a filling operation, fitting the loading mouth in a corresponding support of the upper bridge, fitting surplus flexible material of the flexible receptacle in the slot in the upper bridge, and connecting an outer unloading conduit with the loading mouth of the flexible recipient to fill the flexible recipient with a material.

8 Claims, 4 Drawing Sheets

Fig. 1
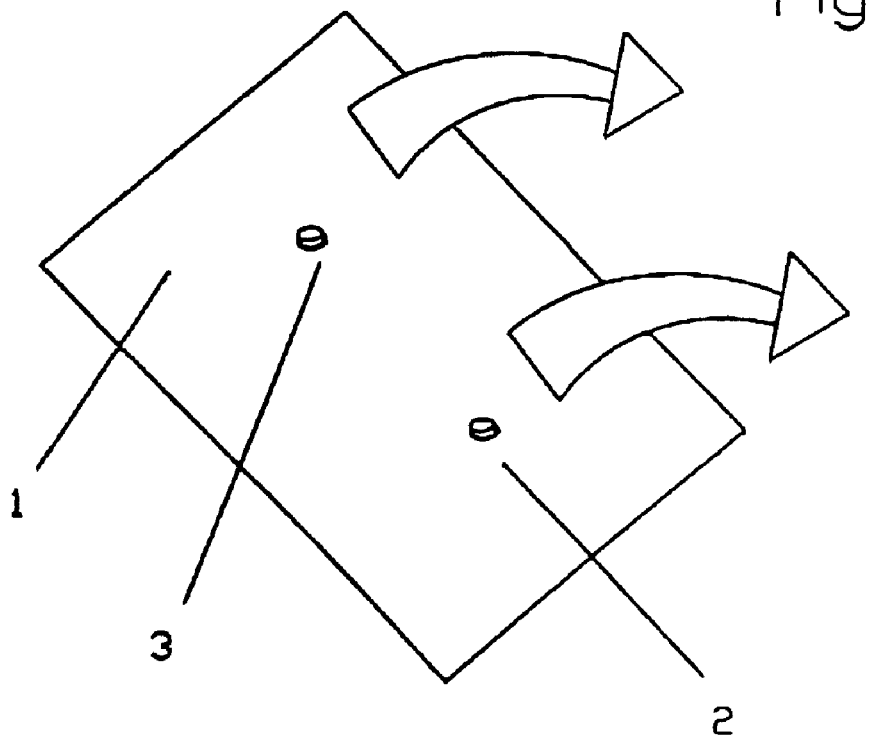
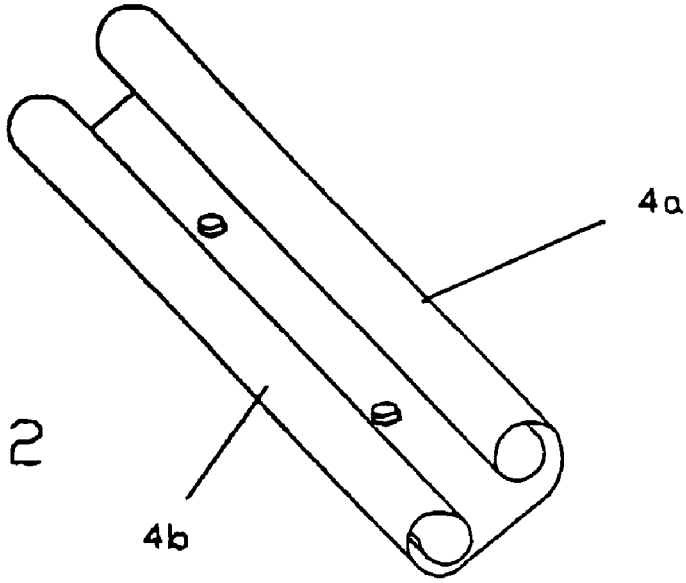
Fig. 2

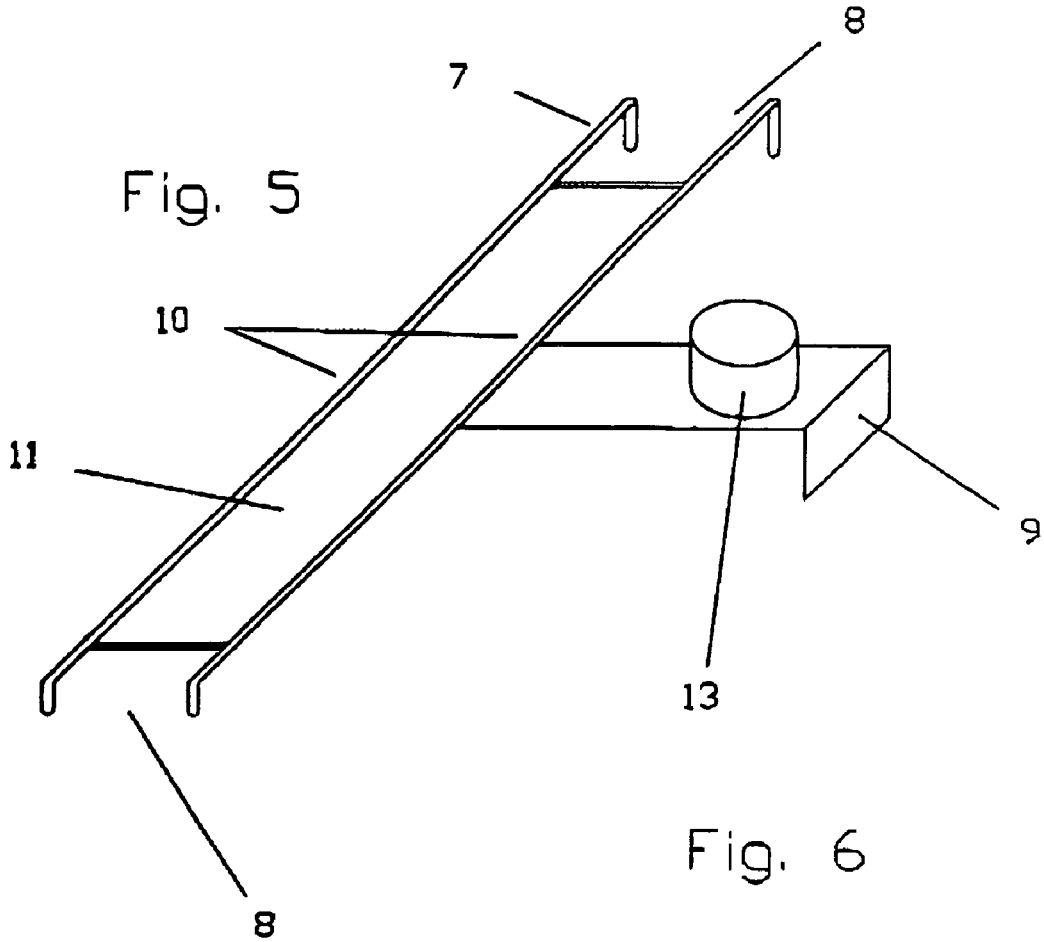
Fig. 5
Fig. 6
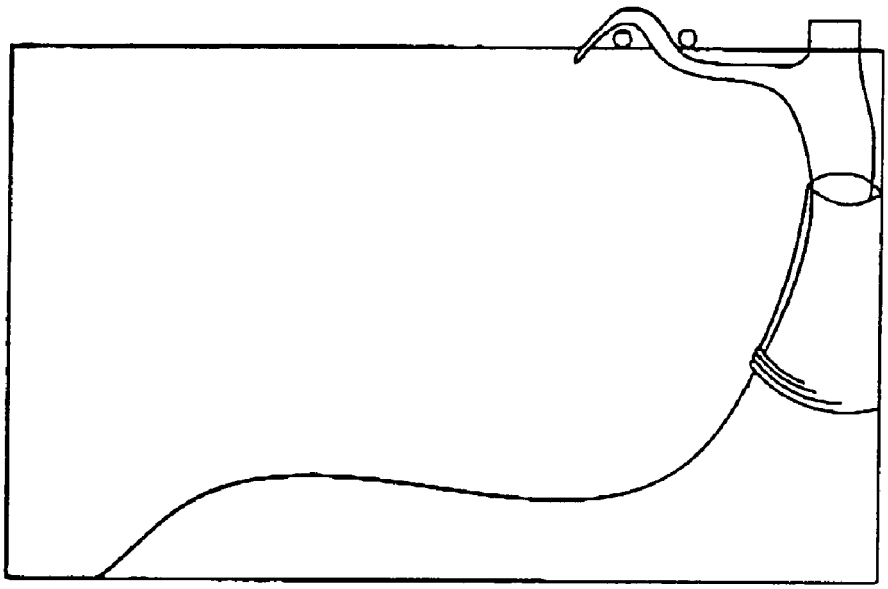

PROCEDURE FOR FILLING FLEXIBLE RECIPIENTS NORMALLY SET ON CRATE-TYPE RIGID OR SEMI-RIGID PALLETIZED RECEPTACLES AND THE SET OF DEVICES REQUIRED FOR PERFORMING SAID FILLING OPERATION

BACKGROUND OF THE INVENTION

This invention covers a procedure and corresponding set of devices for carrying out this procedure, which involves a flexible recipient set on a rigid or semi-rigid support, a support for the filling mouth of the recipient, a folding system and a wrapping for holding the flexible recipient for its progressive unfolding.

STATE OF THE ART

The transport of fluid or pasty materials requires the use of recipients which are extremely strong and thus able to stand up to any external aggressions which may be caused during handling and transport itself.

The transport of these fluid or pasty materials has been done directly in rigid or semi-rigid recipients, with the corresponding problems as regards the cost of the recipient, and the cost of cleaning this after each use. This problem is worsened when the products to be transported are sterile products, which requires a far more complex treatment in the process for cleaning-sterilising the recipient.

For this purpose flexible recipients have been developed for incorporation in rigid or semi-rigid receptacles.

WO 95/18754 refers to a container for granule-type or liquid products which includes a foldable frame fitted with a base and folding columns on this base, which supports a flexible recipient. Nevertheless, this provides no solution as regards the way the flexible recipient is filled, and neither does it solve the problem of the folds that may arise. The recipient is also easily attacked by any external medium as it is not provided with any protection.

EP 0642453 refers to a method for folding an internal coating for a container, which has a folded flexible recipient fitted with a filling mouth and a product outlet mouth, this recipient being fitted with an outer protection wrapping. The filling mouth is held in an upper position by means of a support similar to a fork set on one side of the covering of the container recipient. In this invention there is no effective solution for getting rid of the folds that are formed during its filling, and that after being trapped by the internal mass of the recipient become impossible to remove, considerably reducing the recipient's load capacity. Furthermore, since the folding of the flexible recipient is done from the outside, on both sides of the loading/unloading mouths there are also unwanted tensions which have an effect on the amount of the folds.

GB 2246336 and GB 2194512 both disclose a device for filling a flexible recipient in a container, which has a set of protection plates fixed on its surface in the areas occupying lateral positions and bottom when the recipient is full. Though this solution is ineffective when the filling requires a certain height in the loading mouth, it is also expensive, since the protection plates on the bag for its lateral sides are disposable and thus cannot be used in any further filling operation.

A solution similar to GB 2246336 is disclosed in EP 0362730, whose disadvantages are identical to the ones mentioned in the former.

DE 2900998 discloses a flexible recipient for cylindrical recipients, in which the unfolding of the bag is limited by a flexible external wrapping, able to be retracted as the recipient is filled. The problem of folds found in quadrangular recipients is much greater than the folding in cylindrical recipients. What is more, in this case the flexible recipient is located in a central zone, on the same axis on which the loading and unloading mouths are located, while in quadrangular recipients this has to be located in a zone adjacent to the side on which the unloading mouth is found.

FR 2525568 discloses a folding flexible recipient, whose shape is formed by a set of covering pieces joined to said recipient. This recipient is not usable in receptacles, in which the filling has to be done at the maximum height of the crate or receptacle in which this is located, apart from other disadvantages described above.

GB 1051516 also discloses a folding recipient fitted with joined covers, with the same disadvantages as those stated.

And finally, FR 2395913 discloses a recipient fitted with rigid walls joined to this, connected to a body of the same material for holding the filling mouth. The same disadvantage that has been stressed for the preceding inventions is present in this one, since it does not provide any solution for the problem of the folding produced during filling.

SUMMARY OF THE INVENTION

This invention covers a procedure for filling flexible recipients in rigid packages, in which the filling operation is performed in such a way that its development throughout the filling process forms the minimum amount of folds.

More specifically, on a crate-type palletised receptacle or rigid receptacle it involves placing a part for holding the loading mouth to be able to adapt this to loading devices which require this pre-set loading height, using a set of bars beside the holding zone for holding the surplus of the flexible recipient in each of its filling stages, with a rolling up system inwards on both sides of the loading/unloading mouths. The holding part has a hole with a greater diameter than that of the loading valve for its placement and a slot for sustaining this in the loading position, at least a pair of rods which define a slot through which the surplus of the flexible recipient is sustained, and preferably an articulation means. Between the flexible recipient and the outer crate there is a separating covering made of a material such as card, wood, plastic or metal sheets. If the recipient has smooth walls, this part will not be necessary, though still advisable.

SHORT DESCRIPTION OF THE DRAWINGS

To illustrate the explanation which is to follow, we enclose herewith four sheets of drawings, representing the essence of this invention in eight figures, and in which:

FIG. 1 shows the bag, formed of one or more sheets of flexible plastic material joined together, in which the loading and unloading mouths can be seen;

FIG. 2 shows a view in which the form of bag folding is seen;

FIG. 5 shows a view of the bridge, preferable hinged on the corresponding edge of the crate on which this is located; and finally FIGS. 6, 7 and 8 show a view of the filling process of the recipient in the receptacle.

DETAILED DESCRIPTION OF THE INVENTION

Figure 3:
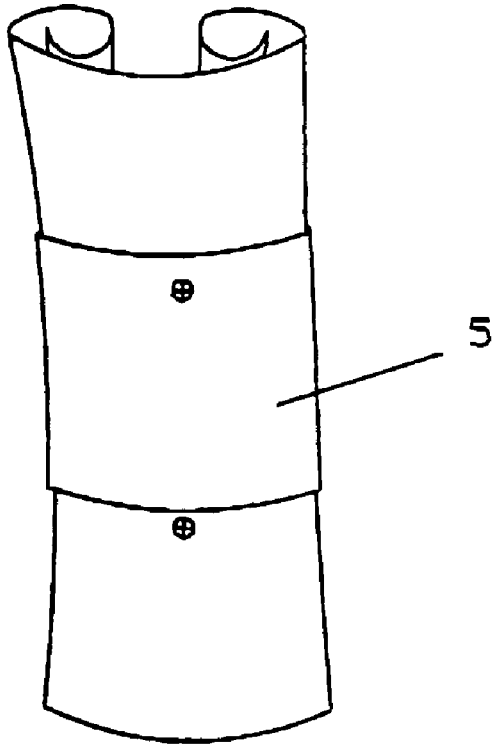
FIG. 3 shows a view displaying how the folded bag is wrapped in a tube of flexible laminated material.

In accordance with the invention, we propose a new procedure for filling flexible recipients in palletised crates, undertaken as follows;

Preparation of a flexible recipient such as a bag, which is rolled up from the edges towards the centre, at the rear of the loading and unloading mouth end;

placing a flexible sleeve of a plastic material or one of similar characteristics which partly surrounds the height of the rolled-up recipient;

these two steps are preliminary, and can be done at a different moment in time, and even be stored with said operation already performed.

fitting a laminar material covering, such as card, plastic or metal sheets in the palletised crate or outer receptacle, for protecting the flexible recipient against external mechanical action;

The operation for placing the covering in the palletised crate or receptacle can also be done at a separate moment in time, placing the lower discharge mouth of the flexible recipient in the lower recess of the receptacle and covering, where applicable for this purpose;

fitting an upper bridge, on the receptacle or crate, fitted with at least one slot for letting through the surplus flexible material during the initial phases of the filling operation;

fitting the loading mouth in the corresponding support of the upper bridge;

fitting the flexible material on the slot made in the upper bridge;

These two operations can be done in any order, as they are not dependent on each other.

The set of devices involved in the invention includes a flexible recipient, such as a bag, folded from the sides of a central line formed by the loading and unloading mouths, towards said central line, at the rear of said mouths, a set of protection plates for the recipient in respect of the sides of the external receptacle and a support bridge for the loading mouth. The bridge is preferable hinged to the outer receptacle and has an opening for holding the loading mouth, and defines at least one slot for holding the part of the folded flexible recipient not used until now.

With reference to the figures, these display a flexible recipient 1 which, before being loaded, takes on a laminar form and is fitted with at least one loading mouth 2 and at least one unloading mouth 3. Said flexible recipient is rolled up from both sides of the line connecting said mouths towards this line, at the rear, defining two lobes 4*a* and 4*b*. The loading mouths 2 and unloading mouths 3 are visible at the opposite side to that of the rolling up. After rolling up the flexible recipient 1, this is partly covered by a wrapping 5, also flexible, of a material such as a fairly thin plastic material, able to hold the flexible recipient in its folded position. The height of the wrapping on the sleeve will be roughly equal to or somewhat less an the height of the receptacle on which the flexible recipient is set or simply the distance between the loading and unloading mouths.

Figure 4:
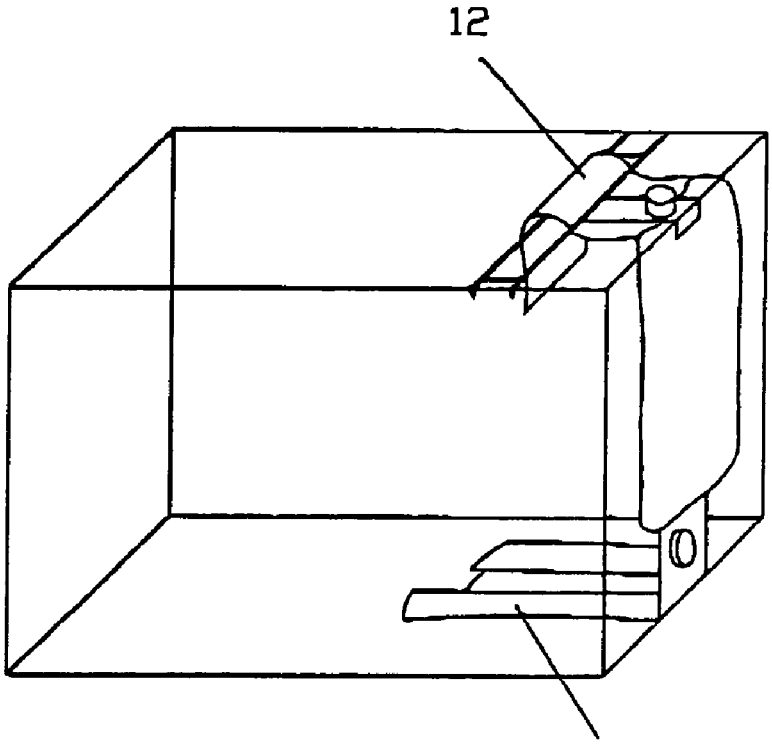
FIG. 4 shows a view of the receptacle provided with a bag or flexible filling recipient in which there is a support bridge for the filling mouth of the flexible recipient.
Figure 7:
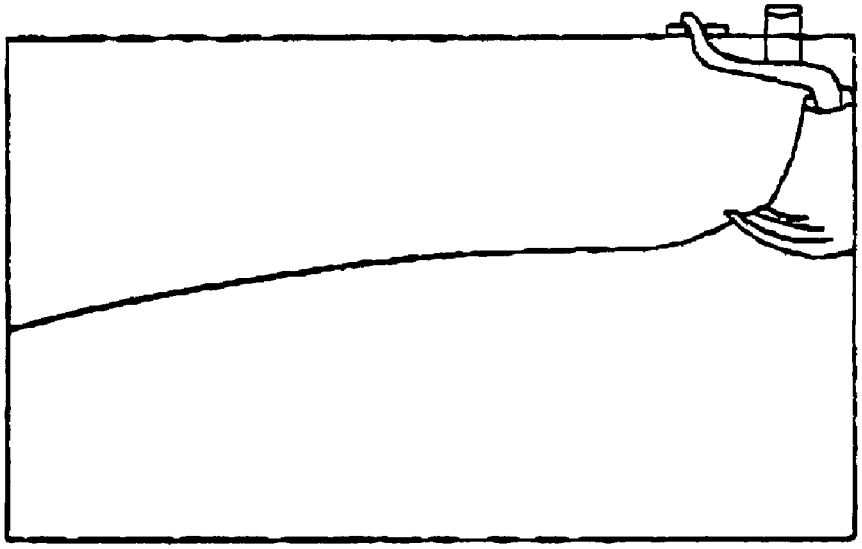
Figure 8:
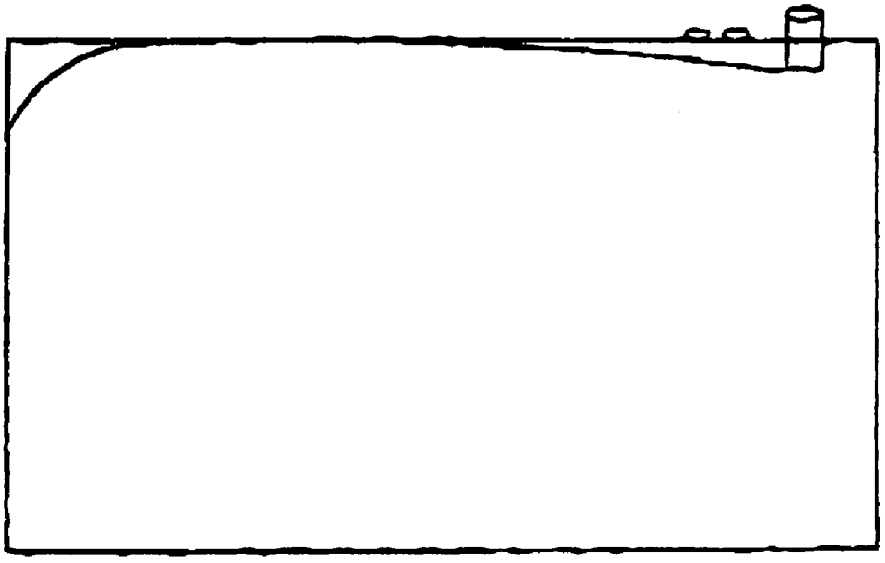

The fitting of the unloading mouth 3 is done at the bottom in the opening meant for this purpose, with the lower surplus 6 of the recipient fitted freely around the base, as this is represented in FIG. 4.

The outer receptacle can be formed of a crate of rods made of metal or other materials, or of a rigid or semi-rigid smooth body. In the first of these cases it is highly advisable to have protection devices limiting any mechanical aggressions that could arise through the mesh forming the crate, while in rigid or semi-rigid smooth receptacles this requirement is not so necessary, though still advisable.

For holding the loading mouth at a suitable height, there is a bridge 7 at the top of the receptacle which preferentially has lateral supports 8 and a frontal support 9, the lateral ones being to guarantee the stability and the front part to guarantee the distance at which the loading mouth is located 2.

It is intended, in a preferential embodiment, for the bridge 7 to form part of the outer receptacle, by an articulation in the front support zone 9 in one of the upper edges of this outer receptacle. Nevertheless, this bridge could also be independent, or partly consist of the rods that form the container.

This bridge has a zone provided with a recess 13 for supporting the loading mouth 2, which has at least one shoulder for holding this.

This bridge also has at least one slot 11, normally defined by two parallel rods 10, between which the upper surplus 12 of the flexible recipient 1 is held and projects during the loading operation.

As the recipient 1 is being filled, the bottom 6 is gradually filled, which means that as is volume increases it forces the wrapping 5 to crease up, and due to its flexibility, the wrapping does not oppose much resistance to this. As the loading level increases, the bottom demands a greater amount of the recipient, which is supplied from the upper surplus, until the recipient is totally filled, when the wrapping 5 takes on a practically annular shape in the loading mouth zone and there is no upper surplus 12 as this has been absorbed by the body of the recipient, until the full volume is reached.

An additional option is that of joining a semi-rigid surface to the bottom of the filling bag, such as a sheet of cardboard, so that this facilitates its proper unfolding as the bag is filled.

Holding the flexible recipient in the bridge allows the filling to be done uniformly, without producing any significant folds during the filling stage which reduce its capacity.

This is for application in manufacturing and filling recipients for industry.

What is claimed is:

1. A system for filling flexible receptacles set on crate-type rigid or semi-rigid palletized outer receptacles, comprising:

a rolled up flexible laminar receptacle having a loading mouth and an unloading mouth;

an outer wrapping which partly covers said rolled up laminar flexible receptacle and leaves uncovered an upper surplus portion of said flexible receptacle which surplus portion includes said loading mouth to be filled during a loading stage; and a bridge for holding the loading mouth in a loading position on top of an outer receptacle during a loading phase, the bridge including a slot for receiving said upper surplus portion of the flexible laminar receptacle therethrough in said loading stage.

2. A system according to claim 1, wherein the outer wrapping has a height defined by a distance between the loading mouth and the unloading mouth.

3. A system according to claim 1, wherein the bridge includes at least one of the following for engagement with the outer receptacle:

lateral holding supports, and a front holding support.

4. A system according to claim 1, wherein the bridge is articulated to an upper edge of the outer receptacle.

5. A system according to claim 1, wherein the bridge includes an insertion zone and a holding zone, the insertion zone having a recess of smaller diameter than the loading mouth.

6. A system according to claim 1, wherein the bridge includes two rods which form the slot, the bridge being adapted to be at least partially formed by the rods.

7. A system according to claim 1, wherein the flexible laminar receptacle has a semi-rigid material on a lower side thereof.

8. A system according to claim 7, wherein the semi-rigid material includes a sheet of cardboard affixed thereto.

* * * * *